US005709313A

United States Patent [19]

Richoux et al.

[11] Patent Number: 5,709,313

[45] Date of Patent: Jan. 20, 1998

[54] DRUM OUTLET CONSTRUCTION

[75] Inventors: Jimmy Richoux, Harvey; Ty Techera, New Orleans, both of La.

[73] Assignee: E & H Investments, Harvey, La.

[21] Appl. No.: 493,631

[22] Filed: Jun. 22, 1995

[51] Int. Cl.[6] ..... B65D 6/40

[52] U.S. Cl. ..... 220/601

[58] Field of Search ..... 220/601, 465, 220/4.04

[56] References Cited

U.S. PATENT DOCUMENTS

| | | | |
|---|---|---|---|
| 1,095,014 | 4/1914 | Mauck et al. . | |
| 1,591,184 | 7/1926 | Reynolds . | |
| 1,623,325 | 4/1927 | Wetmore . | |
| 1,793,296 | 2/1931 | Wilson . | |
| 2,254,924 | 11/1941 | Williams . | |
| 2,332,175 | 10/1943 | Sinclair . | |
| 2,333,822 | 11/1943 | Sample et al. . | |
| 2,412,593 | 12/1946 | Adelman . | |
| 2,447,536 | 8/1948 | Robinson . | |
| 2,460,721 | 2/1949 | Thompson . | |
| 2,686,610 | 8/1954 | Sharpnack, Sr. . | |
| 2,960,954 | 11/1960 | Dearing et al. . | |
| 3,076,670 | 2/1963 | Meyer . | |
| 3,124,267 | 3/1964 | Cetrone . | |
| 3,365,926 | 1/1968 | Price . | |
| 3,466,661 | 9/1969 | Phillips . | |
| 3,923,192 | 12/1975 | Walters . | |
| 4,004,709 | 1/1977 | Simkus . | |
| 4,032,047 | 6/1977 | Wilson . | |
| 4,034,896 | 7/1977 | Wilson . | |
| 4,706,836 | 11/1987 | Greck . | |
| 4,767,021 | 8/1988 | Pies . | |
| 4,852,238 | 8/1989 | Schurr . | |
| 4,972,568 | 11/1990 | Schurr . | |
| 5,016,775 | 5/1991 | Budenbender . | |
| 5,052,576 | 10/1991 | Budenbender . | |
| 5,075,951 | 12/1991 | Schurr et al. | 220/601 X |
| 5,190,181 | 3/1993 | Budenbender . | |
| 5,305,906 | 4/1994 | Dietrich et al. | 220/601 X |
| 5,356,030 | 10/1994 | Budenbender | 220/601 |

FOREIGN PATENT DOCUMENTS

| | | |
|---|---|---|
| 4004885 | 9/1990 | Germany . |

*Primary Examiner*—Steven M. Pollard

*Attorney, Agent, or Firm*—Pravel, Hewitt, Kimball & Krieger

[57] ABSTRACT

A drum outlet and closure apparatus for use with cylindrical steel drums provides an outlet fitting with a peripheral shoulder that is generally S-shaped to accept a cap seal (such as a commercially available metallic cap seal). The shoulder thus protects an inwardly spaced threaded section. In another embodiment, the drum outlet is formed of parent metal of the drum end, formed into an annular shoulder and then partially threaded. An upper unthreaded section is folded to define a closure sealing surface. The threaded section accepts a threaded closure fitting. An unthreaded lower interior section provides enhanced strength and protects the threading.

17 Claims, 12 Drawing Sheets

DRUM OUTLET CONSTRUCTION

BACKGROUND OF THE INVENTION:

1. Field of the Invention

The present invention relates to containers, and a method of manufacturing containers, such as fifty five gallon steel drums and like cylindrical containers for holding oil, chemicals and other liquids and more particularly relates to containers, and the manufacture of containers, with an improved drum outlet apparatus which protects and rigidifies the drum threads of threaded drum outlets with a peripheral shoulder portion.

2. General Background

The chemical industry utilizes various containers for the containing of chemical products. One of the most common types of drums is a thin wall steel drum that is typically manufactured in a fifty-five (55) gallon capacity. Such drums include a cylindrical side wall and a pair of circular ends. One of the ends provides a pair of openings or bungs, one of which is a larger opening for dispensing and filling the drum container, the other of which is a smaller opening for venting the container.

Drum openings can be for example in the two to three inches (2"–3") diameter size for the fill/dispensing opening and one and one half inches (1.5") for the vent opening.

U.S. Pat. No. 2,686,610, issued to E. V. Sharpnack, Sr., entitled "Metal Drum," shows a typical common metal drum as presently used in the industry. These drums are typically standardized to capacities of, for example, 15-gallon, 30-gallon and 55-gallon. Such drums are commonly used to carry an abundance of liquid products, including oil, petrochemicals, chemicals, solvents, water, and the like.

There are various prior art patents which discuss containers and drum constructions for outlet structures used on a cylindrical drum or like container.

An early patent which discusses a process of making metallic barrels is the Mauck et al. U.S. Pat. No. 1,095,0014, entitled "Process Of making Metallic Barrels".

An example of a prior art drum closure which uses an extra fitting mated to the drum stock can be seen in U.S. Pat. No. 4,004,709, issued to V. Simkus, entitled "Drum Closure." In the Simkus patent, a threaded closure construction is disclosed for light-gauge steel drums. The closure provides an internally threaded closure flange mechanically secured within a suitably formed container wall opening. The flange is formed with a cylindrical neck internally threaded throughout its lower extent and surrounded exteriorly by a polygonally shaped base. A resilient sealing gasket tightly surrounds the flange neck at its juncture with the flange base. A perforated drum stock section is formed to overlie and closely surround the flange neck and base in a torque-resisting manner with the upper end of the flange neck beaded outwardly over the surrounding drum stock. The closure is completed with the threaded engagement of a closure plug and application of an overlying tamper-resisting drum seal.

A liquid dispensing container construction is the subject of U.S. Pat. No. 4,032,047, issued to C. Wilson. The apparatus shows a spigot device carried by one of the end portions of a container for dispensing liquid from within the chamber, and a closeable filler device for the chamber is provided in the other of the end portions.

The Wilson U.S. Pat. No. 4,034,896, entitled "Diaphragm Controlled Garden And Orchard Sprayer", discloses a canister having upper and lower flat top portions. The top includes an upper threaded opening having a plug which attaches thereto.

U.S. Pat. No. 3,365,926, is issued to Price and entitled "Manufacture Of Plate Metal Parts With Integral Threaded Fasteners." A plate steel member having a projecting relatively long integral sleeve with concentric sleeve surfaces and a uniform sleeve thickness is made by forming a hole cylindrical throughout its length in a plate blank, extruding a sleeve from metal surrounding the hole under confined compression throughout extrusion flow of the metal, removing the pressure, and then forming a frustro-conical shaped shoulder between the internal sleeve opening and the top plate surface by further downward applied extrusion pressure which sets the metal in the sleeve. The sleeve may be threaded with true and undistorted threads having at least 75% full thread profile capable of resisting torque-tension loading without permanent deformation 30% in excess of the strength of the threads cut in the same steel and requiring a thicker sleeve wall, by removing a thin skin of work-hardened metal from the inner sleeve surface, and then roll-tapping threads by displacement of metal without metal loss throughout the length of the sleeve in the internal sleeve surface. The threaded sleeve member may be incorporated as a component of a composite metal-rubber product by molding an extrusion formed sleeve member before threading with and bonding it to the rubber, then removing the rubber flash from the interior of the sleeve at the same time that the thin skin of work-hardened metal is removed from the inner sleeve surface, and then roll-forming the threads.

U.S. Pat. No. 4,767,021 entitled "Container" provides a container, in particular a drum, having at least one bung in the top head and a central head surface arched inwardly and an adjoining outer head surface sloping obliquely to the shell or wall of the container. The bung is arranged in a funnel-shaped elevation on the top head and a drainage channel is provided in the transition region between the central and outer head surfaces. The channel has a continual slope toward the bung to direct liquid to the bung when the container is inverted. The '021 patent names Gunther Pies as inventor as is assigned to Mauzer-Werke GMBH of Germany as assignee.

A German publication DE4004885 shows a cylindrical drum having a pair of opposed end walls and a generally cylindrical circular side wall. The first end wall contains a pair of spaced apart openings, while the second end wall provides a sloping surface that communicates with a single drain opening.

SUMMARY OF THE PRESENT INVENTION

The present invention provides a method of forming drum outlets and an improved drum outlet for use with cylindrical steel drums and the like that includes a circular and generally flat end plate member having inner and outer surfaces.

A pair of outlets of different diameter are formed in the plate member including a first larger opening for filling and dispensing contents of the drum and a second smaller opening for venting the drum during filling/dispensing.

An annular shoulder portion formed from the drum end surrounds the larger opening and having an inner annular threaded portion. The annular shoulder defines a protective annular surface extending above the surface of the drum end plate and around the threads. The annular shoulder forms a protective member for the threads and in some situations the shoulder defines a fluid collection channel with a threaded portion so that the contents of the drum drain into the channel when the drum is inverted.

In one embodiment, the drum outlet carries a cast or machined fitting that is threaded and held by the annular shoulder. A portion of the shoulder is threaded. A closure cap fits the threads and forms a seal with an upper edge of the shoulder.

In another embodiment, a cap seal is provided that has locking and sealing features.

In another embodiment, a separate threaded fitting is supported at the drum outlet opening with the annular shoulder, and a closure plug compresses a pair of seals upon full closure.

In yet another embodiment, the present invention comprises a closure plug for a drum outlet including an upwardly projecting, annular shoulder having a threaded section, the closure plug including a cap having thread means for engaging the threaded section of the threaded shoulder, a gasket means for effecting a seal between the cap and the shoulder portion, and pilot means for engaging the shoulder means before the thread means of the cap engage the threaded section of the threaded shoulder when the cap is being threaded onto the threaded shoulder. Preferably, a unitary piece acts as the gasket means and the pilot means. The unitary piece can be separate from, but adhered to, the cap. For economy, the cap can be made of a plastic material with an injection molding process. A cap seal, which can be a standard, commercially available cap seal made of light gauge aluminum, is preferably disposed over the cap after the cap is screwed onto a drum outlet.

In an embodiment of the method, in a first operation, the opening is formed first by forming an upwardly rising bubble in the metal of the can top. Next, a hole (for example, a 1 to 2 inch opening) is pierced in the bubble. At this time also, in another embodiment of the present invention, a few (for example, three) small holes can also be pierced in the bubble. These small holes will eventually become drain holes in the finished product.

Next, in a second operation, the metal is then extruded downwardly into the bubble, from the hole pierced in the bubble, so as to form a tub inwardly into the drum.

Then, in a third operation, the leading edge of the tube is then extruded back upon itself so that it curls outwardly from the center of the tube and upwardly. These features, the upper annular shoulder of the tube at what was the top of the bubble, and the lower annular curl, provide support for the subsequent threading of the interior of the tube. In addition, the lower curled portion provides a lower section of the tube that is not threaded; such that the threading does not extend to the complete end of the tubing material.

Next, the interior surface of the tube is threaded. For example, in an embodiment of the present invention, the interior of the tube is threaded through compressive displacement; such as by using a thread forming tap.

Also, during or after the threading process, in an embodiment of the present invention the lower curled section of the tube is further compressed upwardly so that it is finally located within the plain of the top of the container.

In addition, in an embodiment of the preferred invention, the exterior of the formed upper shoulder is indented so as to form an indentation. This indentation provides a site, for example, for cap over the plug to be secured.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

FIGS. 1–7 illustrate the preferred embodiment of the apparatus of the present invention designated generally by the numeral 9.

Figure 5:
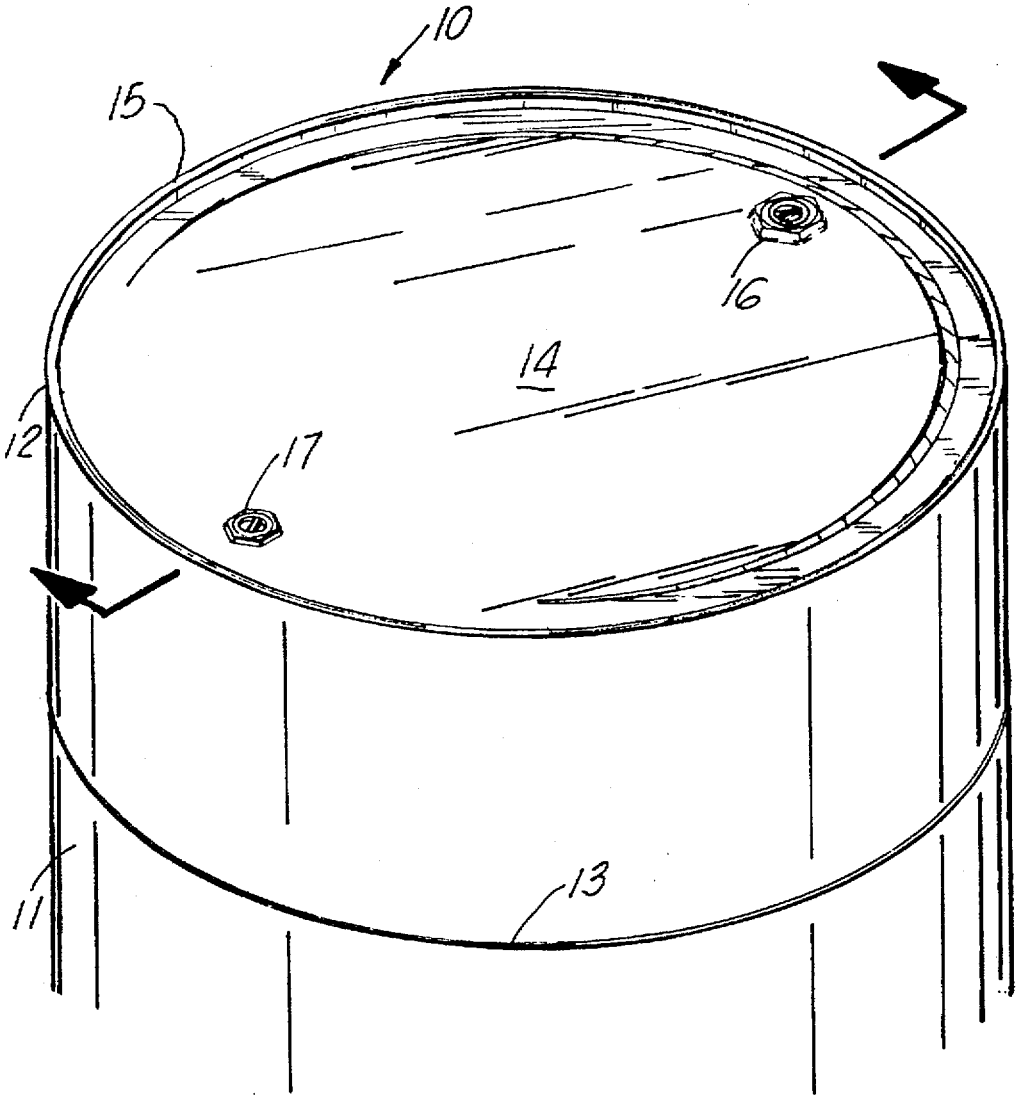
FIG. 5 is a partial perspective view of the preferred embodiment of the apparatus of the present invention.

In FIG. 5, overall drum apparatus 10 is shown as including a cylindrically shaped sidewall 11 of metal, for example, having an upper edge 12 and a corresponding lower edge. The drum sidewall 11 can be provided with multiple annular ribs 13. A pair of circular drum ends are provided including a bottom end (not shown) and a top end in the form of circular lid 14.

Lid 14 carries a pair of spaced apart openings including a larger diameter opening 16 and a smaller diameter opening 17. Typically, the larger diameter opening 16 is for filling and dispensing and the smaller opening 17 functions as a vent opening. The lid 14 can be attached to sidewall 11 at rolled interface 15.

Figure 1:
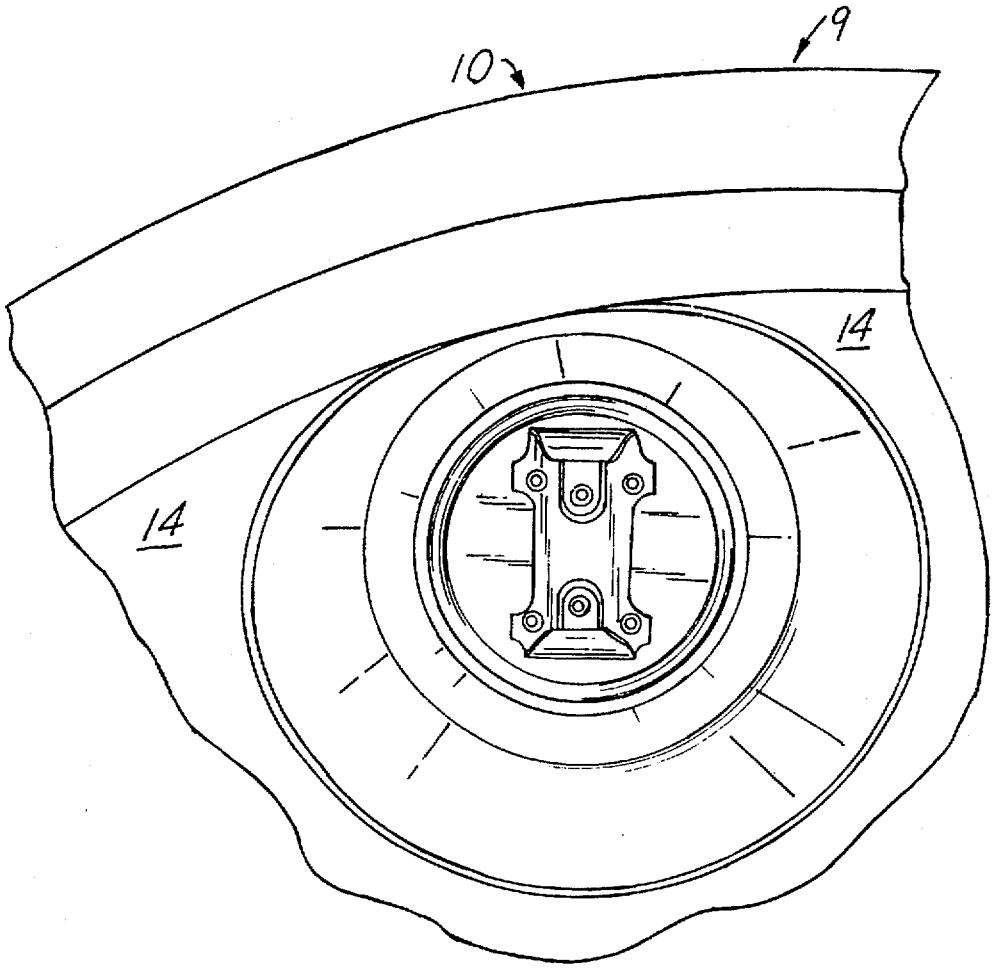
FIG. 1 is a top fragmentary view of the of the preferred embodiment of the apparatus of the present invention.
Figure 2:
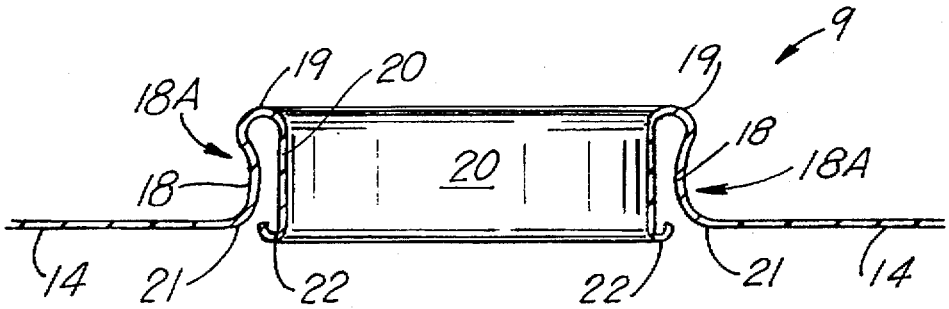
FIG. 2 is a sectional elevational fragmentary view of the of the preferred embodiment of the apparatus of the present invention before threading and illustrating the preferred method of the present invention prior to threading.

The method for forming larger outlet 16 is illustrated in FIGS. 1–4. Larger opening outlet member 16 includes annular shoulder 18 that is formed integrally with and of parent metal from drum lid 14. Annular shoulder 18 is first formed as a straight, unthreaded annular shoulder, generally cylindrical in shape as shown in FIG. 1, but having a concavity 18A. Shoulder 18 connects to drum lid 14 with integrally connected annular section 21. The upper end 19 of shoulder 18 defines an annular U-shaped bend section that communicates with inner annular shoulder 20. The bottom 22 of shoulder 20 defines a second U-shaped bend section.

As part of the method of the present invention, the portions 18–21 are formed in the configuration of FIG. 1 as an initial step, and from the parent metal of drum lid 14.

Figure 3:
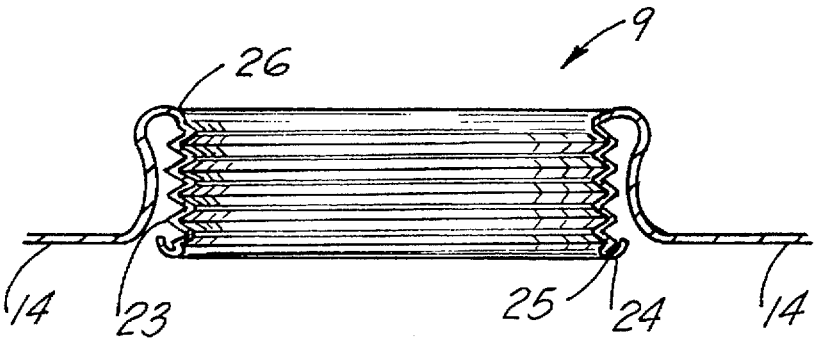
FIG. 3 is a sectional elevational view of the of the preferred embodiment of the apparatus of the present invention.

In FIG. 3, annular shoulder 20 has been threaded between upper end 19 and lower end 22. Threaded section 23 is preferably formed with a thread forming tap or by thread rolling, as described more fully in prior U.S. Pat. Nos. 4,852,238; 4,972,568; and 5,075,951, each of which is incorporated herein by reference. An annular gap 24 remains between shoulders 18 and 20 as seen in FIG. 3.

Figure 4:
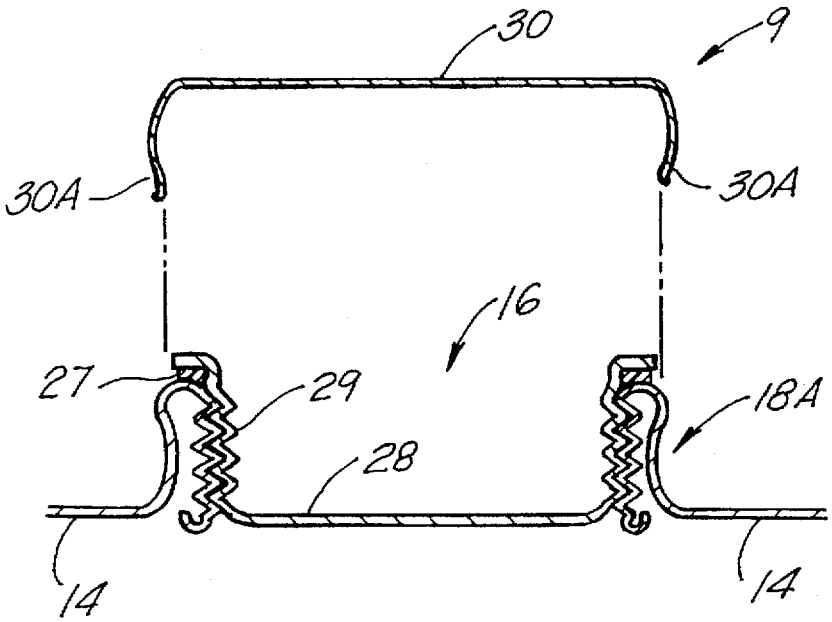
FIG. 4 is an exploded sectional elevational view of the of the preferred embodiment of the apparatus of the present invention.

The threaded section 23 terminates at 25 and 26, leaving unthreaded section 24 above threaded section 23. The uppermost annular surface of U-shaped bend section 19 receives annular seal 27 of closure fitting 28. Fitting 28 is preferably a standard commercially available drum that closure fitting with threads 29 such as that manufactured by RIEKE. A cap seal 30 can be used to seal the assembly of closure member 28 and outlet 16, the cap seal 30 also being a commercially available cap seal such as manufactured by RIEKE. The cap seal 30 has an annular concave flange portion 30A that registers with concavity 18A upon assembly. Threads 29 of fitting 28 register with the threaded portion 23 of outlet member 16 as shown in FIG. 4.

Figure 6:
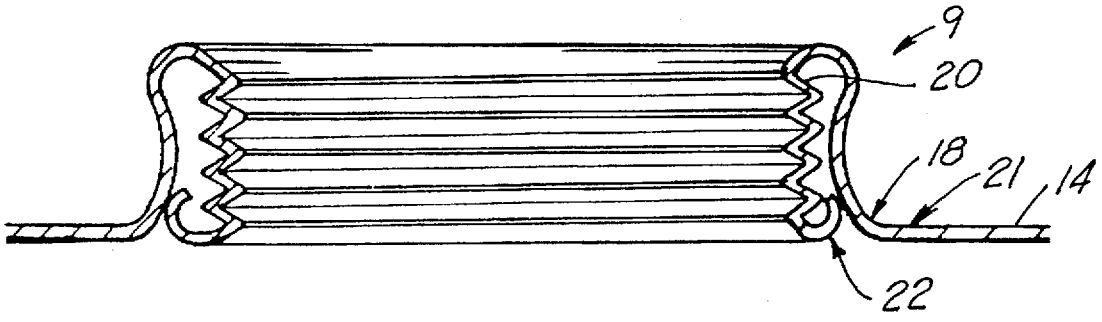
FIG. 6 is a sectional elevational fragmentary view of the preferred embodiment of the apparatus of the present invention.

In FIG. 6, there can be seen close up detail of the lower end of shoulder 22 compressed against drum lid 14 near integrally connected annular section 21 of annular shoulder 18. This shows that in a preferred embodiment, lower end of shoulder 22 is within the plane of drum lid 14, and is crushed against drum lid 14 near integrally connected annular section 21 of annular shoulder 18 so as to preclude any void space between inner annular shoulder 20 and annular shoulder 18.

Figure 7:
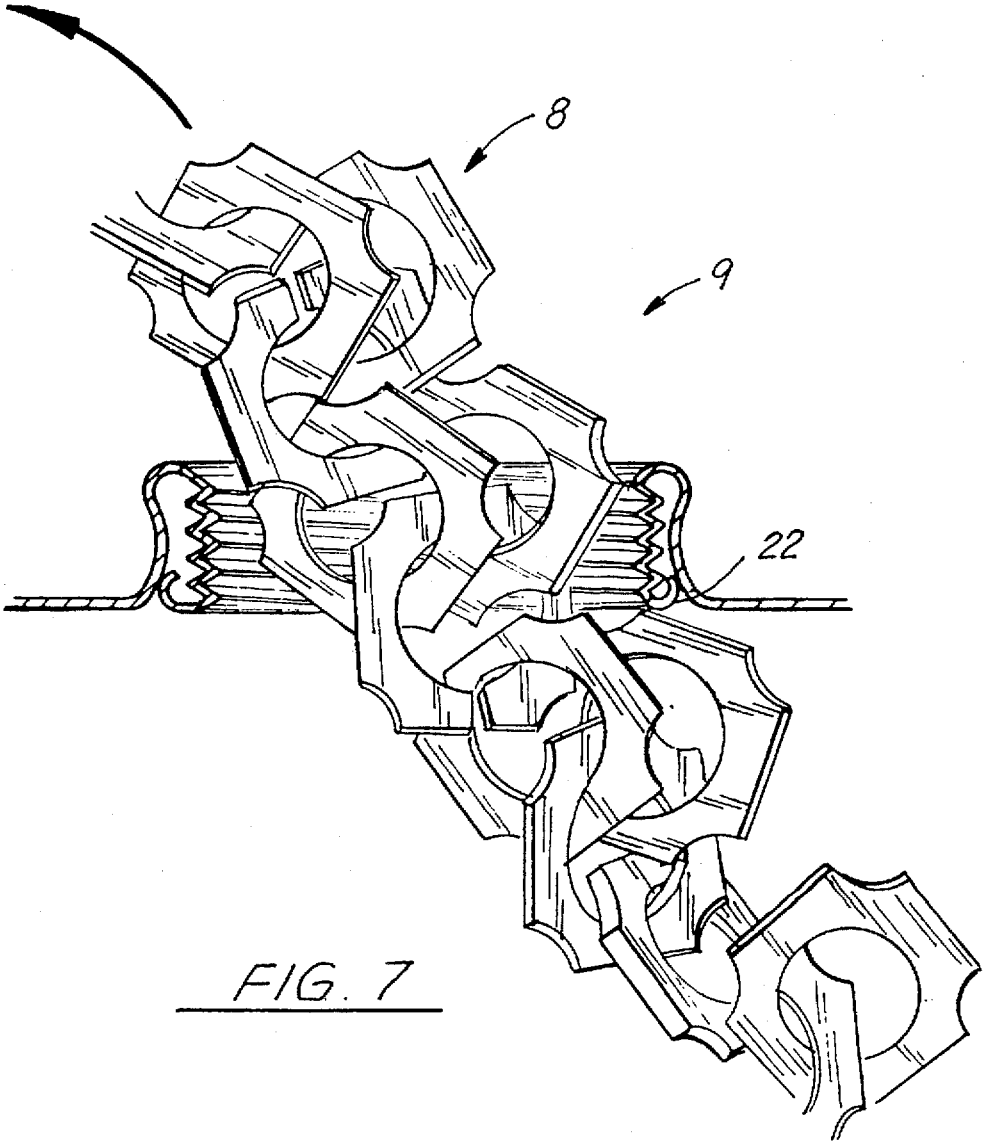
FIG. 7 is a sectional elevational fragmentary view of a preferred embodiment of the apparatus of the present invention showing a tank cleaning chain in use.

In FIG. 7, there can be seen close up detail of the lower end of shoulder 22 being protected from the potentially damaging effects of tank cleaning chain 8. In the art, 55 gallon storage drums are commonly cleaned by tank cleaning chains such as the one shown as part number 8 in FIG. 7. These chains are lowered into the tanks and the tanks are then, for example, rolled about on their sides while the chain removes rust and so forth from the interior surfaces of the drum. Typically, removal of the tank cleaning chains can problems since they could easily damage both exposed threading at the end of bung holes (threading extending to the end), and could tear out the inner lining of double walled holes. As shown in FIG. 7, the instant apparatus overcomes problems posed by the use of cleaning chains since the threads are protected (they do not extend to the end of 22) and the end 22 it self is not susceptible to being torn or attached by the chain 8.

Figure 8:
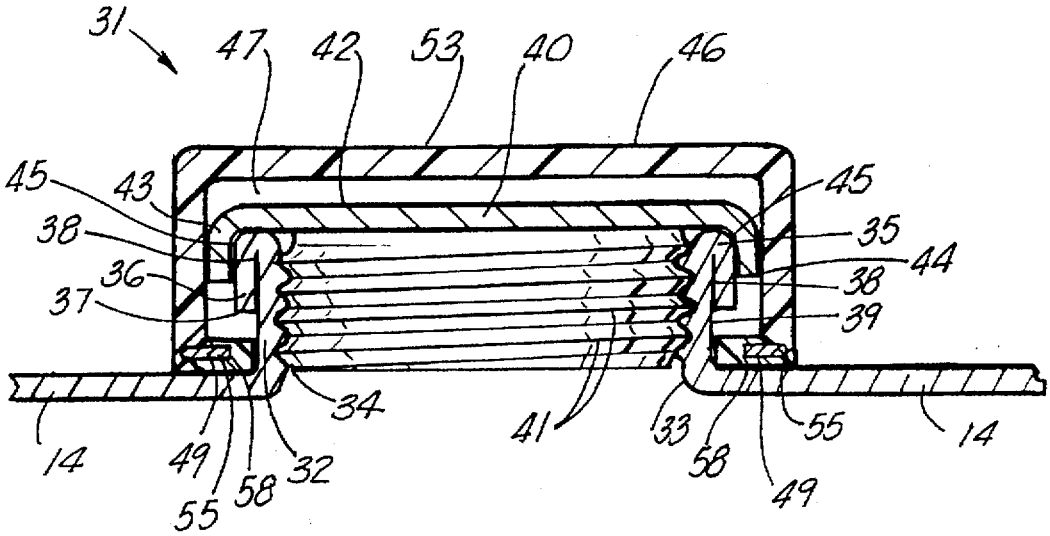
FIG. 8 is a sectional view of an alternate embodiment of the apparatus of the present invention with the drum closure plug shown in closed position.

In FIG. 8, there can be seen another alternative embodiment of the apparatus of the present invention designated by the numeral 31. In FIG. 6, outlet member 31 includes an upwardly extending annular shoulder 32 that attaches at generally right angles to the lid 14 of drum apparatus 10. The number 33 defines the connection between shoulder 32 and lid 14. Shoulder 32 includes an internally threaded section 34 which receives closure plug 40 having external threads 41.

Annular shoulder 32 includes a folded and unthreaded portion 36 that closely abuts the outer surface 39 of annular shoulder 32. The folded portion includes a downwardly extending unthreaded section 36 having a surface 38 that closely abuts and conforms to the outer cylindrically shaped surface 39 of flange 32. In this fashion, the downwardly extending folded portion 36 reinforces threaded section 34, providing a doubling of the thickness of flange 32 in the vicinity of the member 36.

The unthreaded portion 36 has a lower end portion 37 that terminates a distance above lid 14. Plug 40, with external threads 41, has a flat top 42 with an annular lip 43 that overlaps folded portion 35, terminating at annular edge 44. Annular lip 43 closely abuts folded portion 35 along the surface 45 when the plug 40 is rotated to a fully closed position as shown in FIG. 6.

Figure 9:
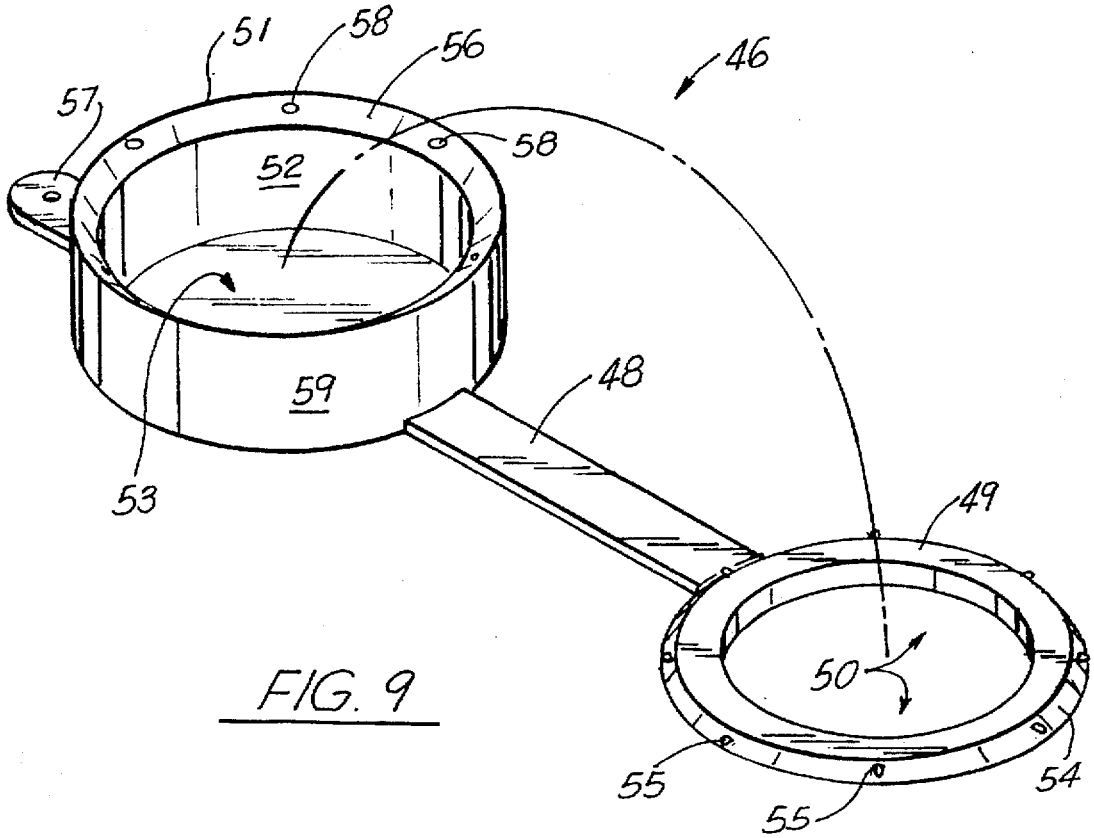
FIG. 9 is a partial, perspective view of an alternate embodiment of the apparatus of the present invention illustrating the drum closure plug and seal.

Plastic seal member 46 (see FIGS. 8–9) extends over plug 42 and shoulder 32. An air space 47 can be provided between plastic seal member 46 and plug 40. Plastic seal member 46 connects with strap 48 to annular ring 49. A circular opening 50 in ring 49 allows ring 49 to be assembled upon annular shoulder 32 as shown in position in FIG. 8. Plastic seal member 46 includes outer surface 59, and a cylindrical plastic seal 51 that attaches to strap 48. The plastic seal 51 includes a cylindrical sidewall 52 and a circular top 53. A beveled surface 54 cooperates with a corresponding beveled surface 56 so that the corresponding beveled surfaces 54, 56 register upon assembly as shown in FIG. 9. Further, upon such assembly, a plurality of circumferentially spaced locking tabs 55 register in similarly spaced recesses 58. Tab 57 can then be used to open and close cylindrical plastic cap 52 upon annular ring 50 and thus form a second seal to outlet member 31.

As part of the method of the present invention, the portion 118 (See FIGS. 10 and 11) is formed in the configuration of FIG. 1 as an initial step, and from the parent metal of drum lid 14.

Figure 10:
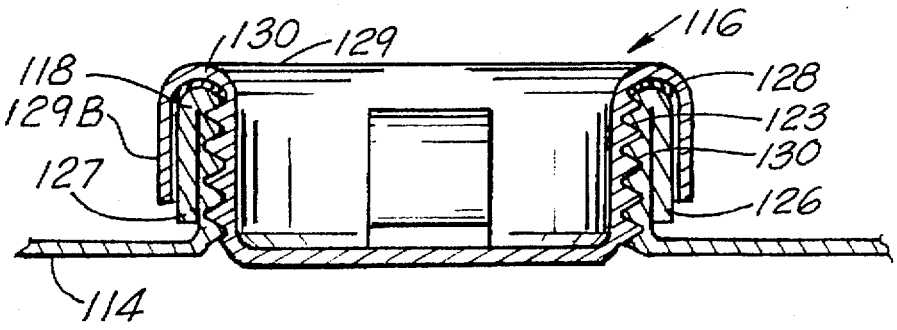
FIG. 10 is a sectional view of another alternate embodiment of the apparatus of the present invention with a drum closure plug shown in closed position.
Figure 11:
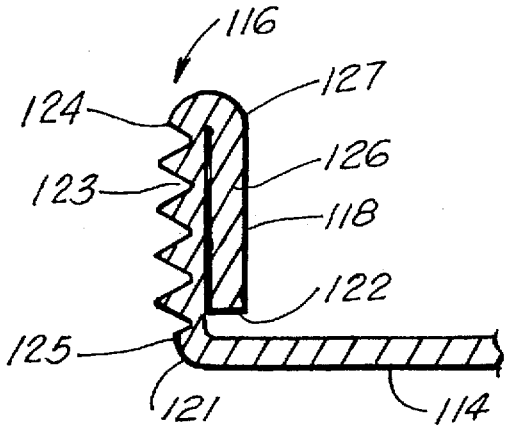
FIG. 11 is a partial sectional view of another alternate embodiment of the apparatus of the present invention.

In FIGS. 10 and 11, annular shoulder 118 has been partially threaded between upper end 122 and lower end 125. Threaded section 123 is preferably formed with a thread forming tap, as described more fully in prior U.S. Pat. Nos. 4,852,238; 4,972,568; and 5,075,951, or by thread rolling with a blank exterior die before section 126 is folded over.

There is an annular interface portion 121 between lid 114 and outlet member 116.

The threaded section 123 terminates at 124, leaving an unthreaded section 126 of annular shoulder 118 above threaded section 123 and extending generally between end 122 and the top 124 of threaded section 123, threaded section 123 extending between top of threaded section 124 and bottom threaded section 125 as shown in FIG. 9. Unthreaded section 126 is folded over to produce folded portion 127. The uppermost annular surface of folded portion 127 receives annular seal 128 of closure fitting 129. Fitting 129 can have an annular folded portion 129B. Threads 130 of fitting 129 register with the threaded portion 123 of outlet member 116 as shown in FIG. 8.

As part of the method of the present invention, the portion 218 (See FIG. 11) is formed in the configuration of FIG. 1 as an initial step, and from the parent metal of drum lid 14.

Figure 13:
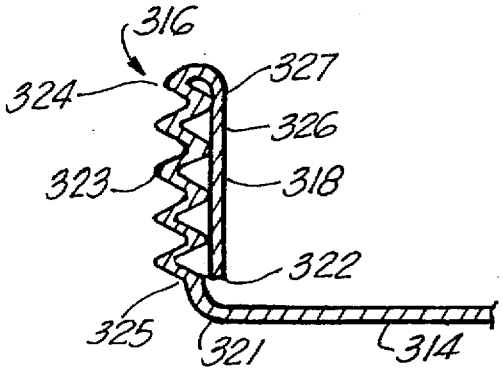
FIG. 13 is a partial sectional view of a of another alternate embodiment of the apparatus of the present invention.

In FIG. 13, annular shoulder 218 has been partially threaded between upper end 222 and lower end 225. Threaded section 223 is preferably formed by thread rolling with a blank exterior die after section 226 is folded over.

There is an annular interface portion 221 between lid 214 and outlet member 216.

The threaded section 223 terminates at 224, leaving a section 226 of annular shoulder 218 above threaded section 223 and extending generally between end 222 and the top 224 of threaded section 223. Section 226 is folded over to produce folded portion 227. The uppermost annular surface of folded portion 227 receives annular seal 128 of closure fitting 129. Threads 130 of fitting 129 register with the threaded portion 223 of outlet member 216.

As part of the method of the present invention, the portion 318 (see FIG. 13) is formed in the configuration of FIG. 1 as an initial step, and from the parent metal of drum lid 14.

In FIG. 13, annular shoulder 318 has been partially threaded between upper end 322 and lower end 325. Threaded section 323 is preferably formed by thread rolling, as described more fully in prior U.S. Pat. Nos. 4,852,238; 4,972,568; and 5,075,951, prior to section 326 being folded over.

There is an annular interface portion 321 between lid 314 and outlet member 316.

The threaded section 323 terminates at 324, leaving an unthreaded section 326 of annular shoulder 318 above threaded section 323 and extending generally between end 322 and top 324 of threaded section 323. Unthreaded section 326 is folded over to produce folded portion 327. The uppermost annular surface of folded portion 327 receives annular seal 128 of closure fitting 129. Threads 130 of fitting 129 register with the threaded portion 323 of outlet member 316.

Figure 14:
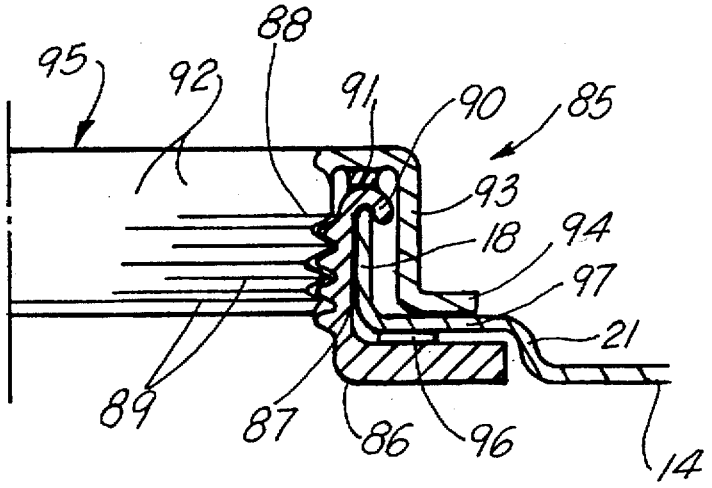
FIG. 14 is another alternative embodiment of the apparatus of the present invention.

FIG. 14 shows another alternate embodiment of the apparatus of the present invention, designated generally by the numeral 85. In the embodiment of FIG. 14, the outlet member 85 is formed of parent metal of the drum end 14 that is first formed in an upwardly extending annular shoulder 18. The shoulder 18 connects to the drum end 14 with annular convex portion 21. In the embodiment of FIG. 14, the shoulder 18 supports a fitting 86 that includes a generally L-shaped annular section 87. The L-shaped annular section 87 includes internal threaded portion 88 which engages the external threads 89 of closure plug 92 during use.

Figure 12:
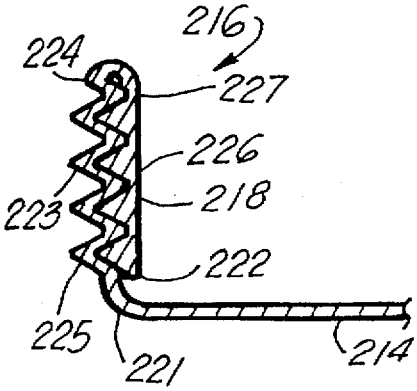
FIG. 12 is a partial sectional view of another alternate embodiment of the apparatus of the present invention.

Fitting 86 includes an arcuate annular portion 90 which initially is formed as an upwardly extending vertical portion, and that is later rolled downwardly into the folded arcuate configuration of FIG. 12. In closed position, the fitting 86 engages the annular shoulder 18. An annular seal 91 such as a rubber annular washer can be placed between arcuate annular portion 90 and closure plug 92. A second annular seal 96 can be positioned between the convex portion 21 of drum end 14 and fitting 86.

Closure plug 92 includes a cylindrical wall portion 93 that is integrally formed with the closure plug 92, beginning at the top 95 thereof and extending downwardly to meet with annular flange 94 portion of plug 92. When plug 92 is threadably engaged upon fitting 86, and rotated to a fully closed position, a double seal is thus formed at 91 and at 96. The compression of threads 88 and 89 upon each other when the plug 92 is fully tightened compresses the seals 91, 96 as the flange 94 engages flat annular surface 97. Continued tightening of the closure plug 92 lifts fitting 86 upwardly, compressing seal 96 between fitting 86 and drum end 14. Similarly, continued tightening of closure plug 92 compresses seal 91 between plug 92 and arcuate annular portion 90.

Figure 15:
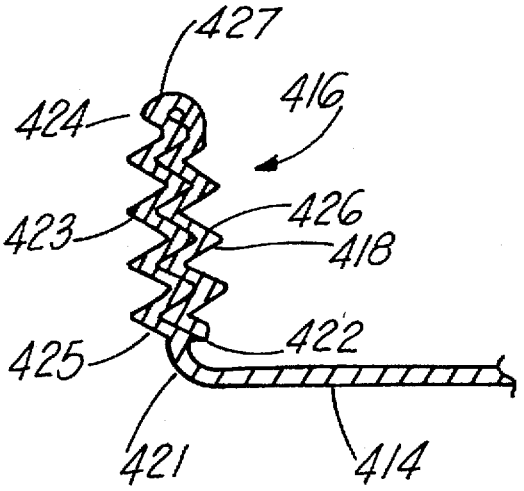
FIG. 15 is a partial sectional view of another alternate embodiment of the apparatus of the present invention.

As part of the method of the present invention, the portion 418 shown in FIG. 15 is formed in the configuration of FIG. 1 as an initial step, and from the parent metal of drum lid 14.

In FIG. 15, annular shoulder 418 has been partially threaded between upper end 422 and lower end 425. Threaded section 423 is preferably formed by thread rolling with a threaded exterior die after section 426 is folded over, as more fully described in U.S. Pat. No. 5,075,951.

There is an annular interface portion 421 between lid 414 and outlet member 416.

The threaded section 423 runs between bottom of threaded section 425 and terminates at 424, leaving a section 426 of annular shoulder 418 above threaded section 423 and extending generally between end 422 and top 424 of threaded section 423. Section 426 is folded over to produce folded portion 427. The uppermost annular surface of folded portion 427 receives annular seal 128 of closure fitting 129. Threads 130 of fitting 129 register with the threaded portion 423 of outlet member 416.

Figure 16:
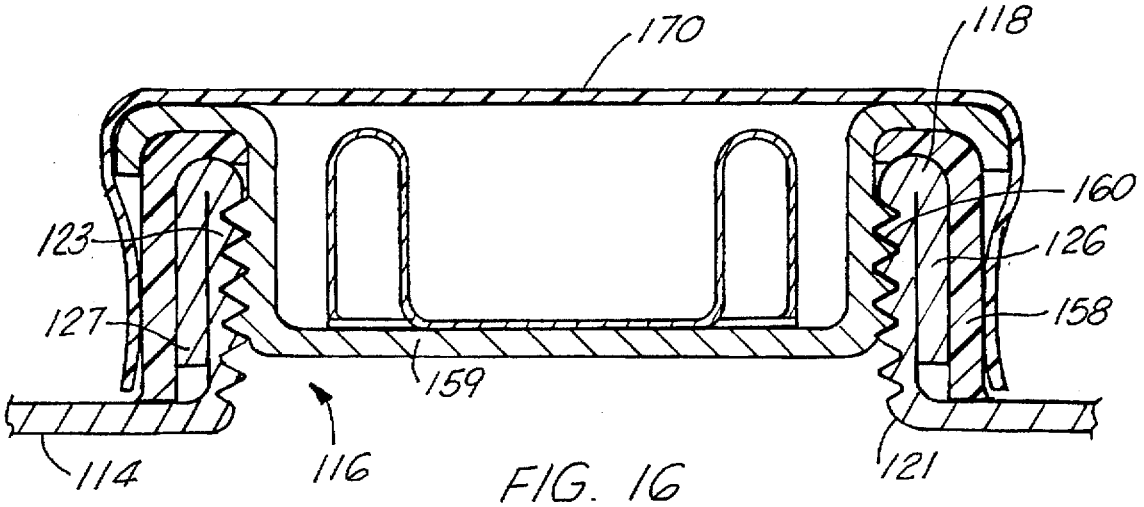
FIG. 16 is a sectional view of another alternative embodiment of the apparatus of the present invention with an alternative drum closure plug of the present invention shown in closed position.
Figure 17:
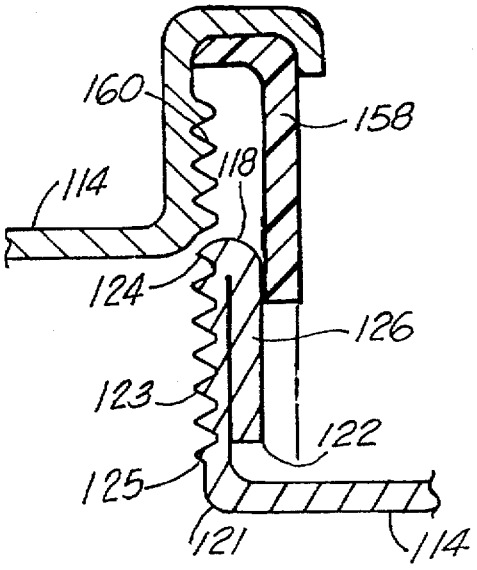
FIG. 17 is a detail of a sectional view of another alternate embodiment of the apparatus of the present invention with the alternative drum closure plug of the present invention shown as the gasket pilots on the outside of the closure.
Figure 18:
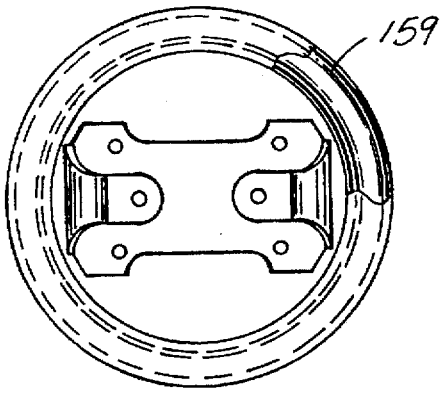
FIG. 18 is a top view of the alternative drum closure plug of the present invention.

In FIGS. 16–18, an alternative drum closure plug 159 of the present invention is shown. Alternative drum closure plug 159 differs from drum closure plug 129 in the following respects: first, it is slightly shorter, so that the lower end of gasket 158 extends below its bottom when plug 159 is being screwed onto outlet member 116; second, it has a gasket 158 attached thereto with glue or some other suitable adhesive; and third, it can advantageously be made of a plastic material with an injection molding process. A standard, commercially available cap seal 170, preferably made of light gauge aluminum, is disposed over cap 159.

In operation, cap 159 is formed in the shape shown in FIGS. 16–18, then gasket 158 is attached thereto with glue or some other suitable adhesive. Gasket 158 acts as an external pilot as well as a seal, leading the threads of cap 159 such that gasket 158 engages the exterior of the closure at section 126 before threads 160 of cap 159 engage threads 123.

Because closure 116 extends upward out of the drum, leaking of fluid past the threads 123 would result in the fluid collecting on drum lid 114. Plug 159 is designed such that the bottom of gasket 158 seals against the top of drum lid 114 (see FIG. 16) to prevent any fluid which may leak through the threads from leaking past between gasket 158 and drum lid 114.

After the plug 159 is screwed onto closure 116, and gasket 158 is seated against the top of the drum, a cap seal 170 is placed onto plug 159 and crimped into place.

Plastic is a desirable material out of which to make plug 159, as it enables injection molding which costs much less than producing metal plugs; however, plastic mis-threads easily. Providing gasket 158 which acts as a pilot for threads 160 allows this softer material which mis-threads easily to be used, at a significant cost savings. Gasket 158 can be made of any suitable material, such as synthetic rubber, which is resilient enough to act as a pilot and soft enough to act as a seal.

Figure 20:
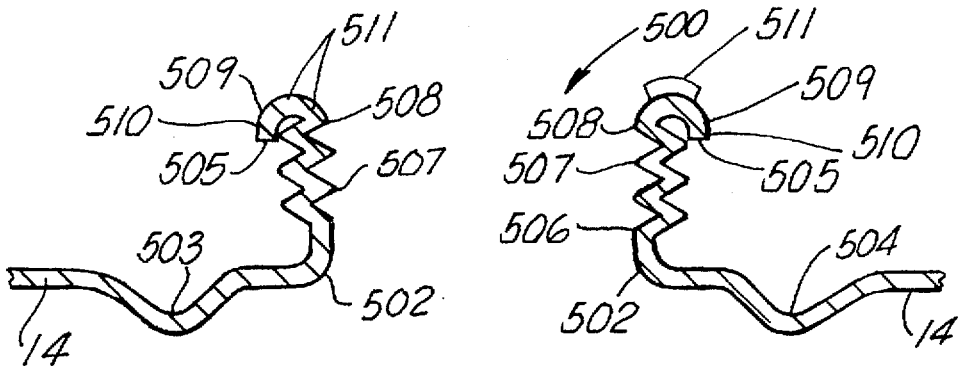
FIG. 20 is a partial sectional elevational view of another alternate method of the present invention.
Figure 21:
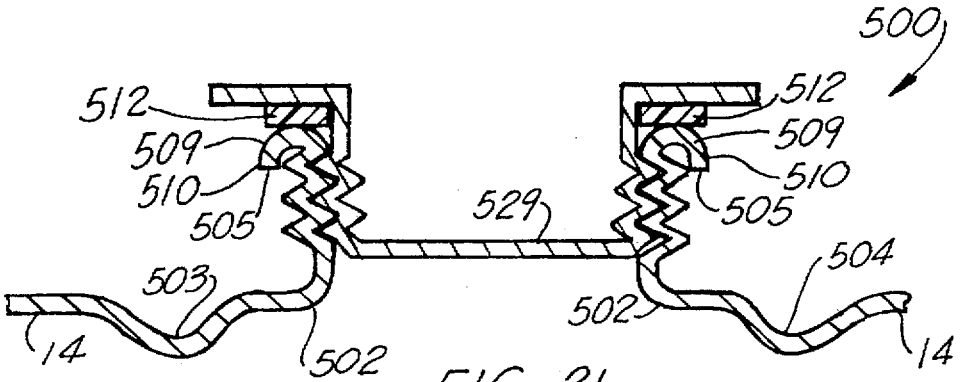
FIG. 21 is a partial sectional elevational view illustrating the final step of another alternate method, and another alternate apparatus of the present invention.
Figure 22:
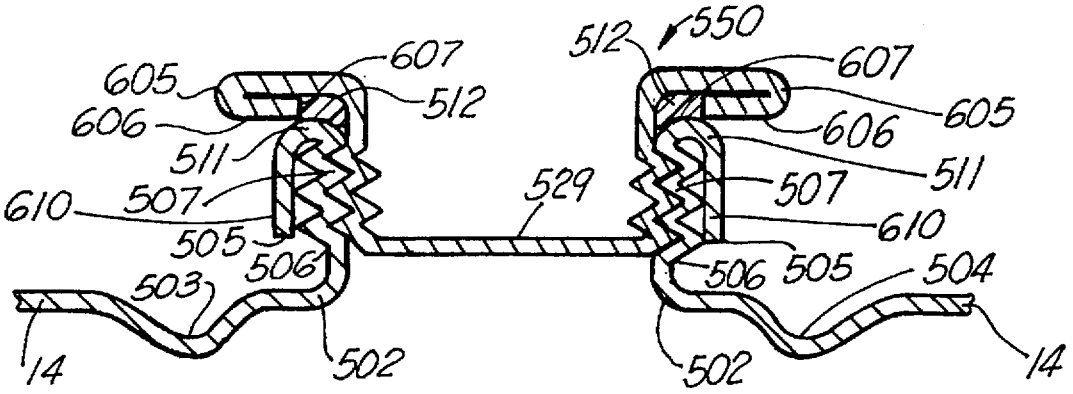
FIG. 22 is a sectional elevational view of another alternate embodiment of the apparatus of the present invention.

FIGS. 20 and 21 show another alternative embodiment of the present invention, designated generally by the numeral 500. FIG. 22 shows another alternative embodiment of the present invention, designated generally by the numeral 550.

Figure 19:
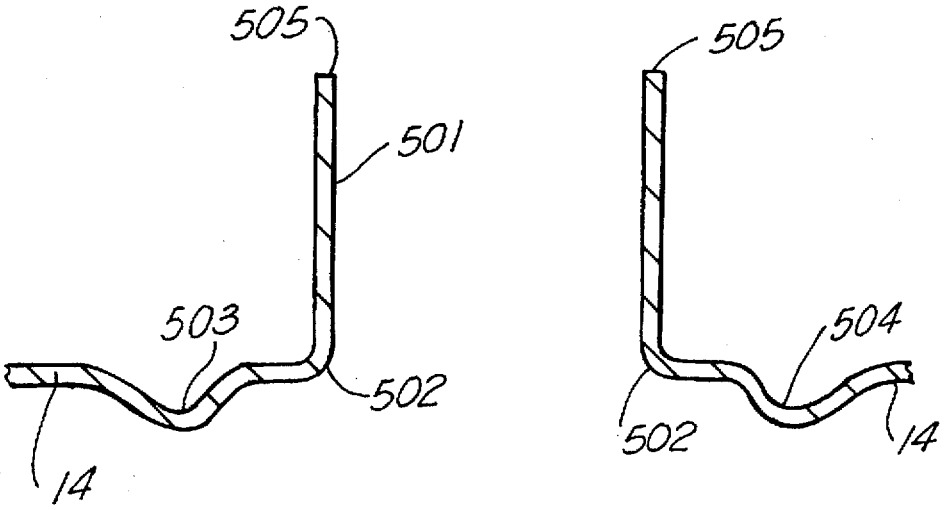
FIG. 19 is a partial sectional elevational view illustrating a step of an alternate method of the present invention.
Figure 23:
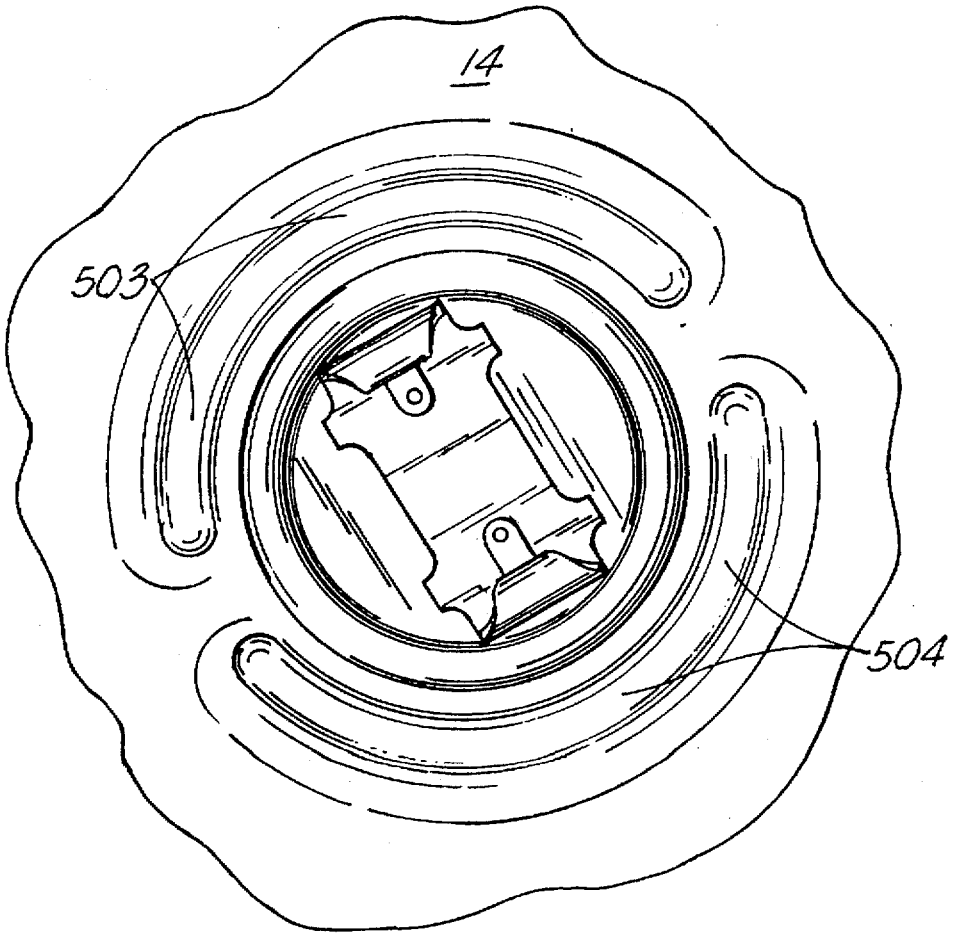
FIG. 23 is a partial, top view of another alternate embodiment of the apparatus of the present invention.

The initial steps in the method for forming alternative outlet member 500 are illustrated in FIGS. 19–21, and the initial steps in the method for forming alternative outlet member 550 are illustrated in FIGS. 19 and 22. Alternative outlet members 500 and 550 include annular shoulder 501 that is formed integrally with and of parent metal from drum lid 14. Annular shoulder 501 is first formed as a straight, unthreaded annular shoulder, generally cylindrical in shape as shown in FIG. 19. Shoulder 501 connects to drum lid 14 with integrally connected annular convex section 502. A pair of generally U-shaped embossed sections 503, 504, form the reinforcement between the annular shoulder 501 and drum lid 14 as shown in FIGS. 19 and 23.

As part of the method of these alternative embodiments of the present invention, the portions 501–504 are formed in the configuration of FIG. 17 as an initial step, and from the parent metal of drum lid 14.

In FIG. 20, annular shoulder 501 has been partially threaded between upper end 505 and lower end of threading 506, threaded section 507 running between upper end of threading 508 and lower end of threading 506. Threaded section 507 is preferably formed with a thread forming tap or by thread rolling, as described more fully in prior U.S. Pat. Nos. 4,852,238; 4,972,568; and 5,075,951, each of which is incorporated herein by reference.

The threaded section 507 terminates at 508, leaving a section 509 of annular shoulder 501 above threaded section 507 and extending generally between end 505 and the top 508 of threaded section 507. Section 509 is folded over to produce folded portion 510. The uppermost annular surface of folded portion 510, 511 receives annular seal 512 of closure fitting 529. Threads 530 of closure fitting 529 register with the threaded portion 507 of outlet member 500.

The alternative embodiment of the present invention 550, as shown in FIG. 22, differs from alternative embodiment 500 in both the closure fitting, 629, and the folded portion, 610. In alternative embodiment 550, folded portion 610 extends down the length of outlet member 550, externally covering threaded section 507, end 505 stopping near lower end of threaded section 506. Also in alternative embodiment 550, as shown in FIG. 22, closure fitting 529 has annularly extended top 605 with folded section 606. End of closure fitting 607 contacts annular seal 512 which forms a seal between closure fitting 529 and upper most annular portion of folded section 610.

Figure 24:
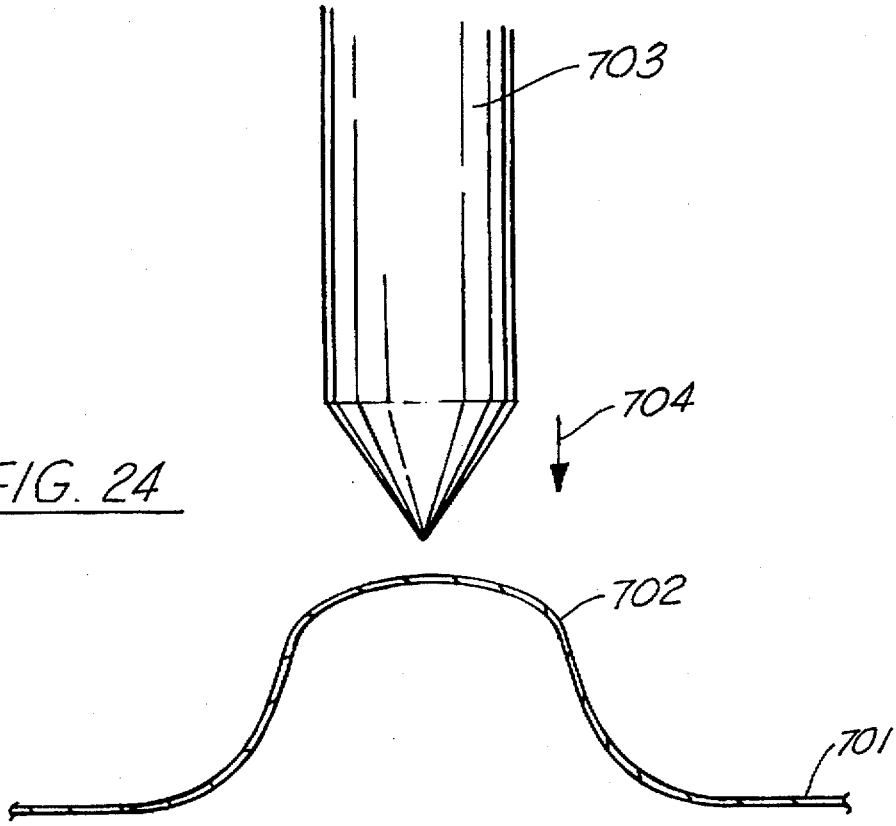
FIG. 24 is a sectional elevational view of an embodiment of the method of the present invention, showing the bubble in the lid, and the piercing means, for example, a mandrel.
Figure 24A:
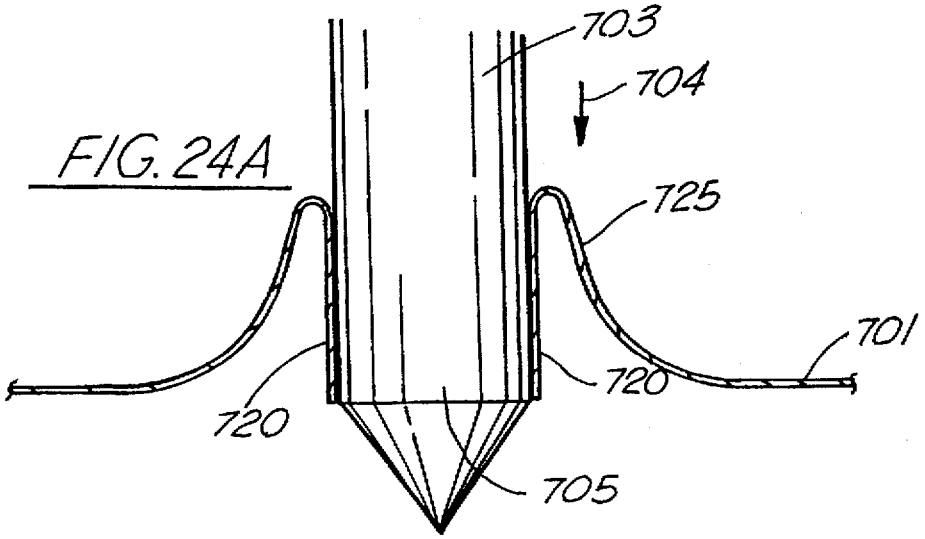
FIG. 24A is a sectional elevational view of an embodiment of the method of the present invention, showing the bubble in the lid, the piercing of the bubble with, for example, a mandrel, and the formation of the inwardly reaching tube.

FIGS. 24 and 24A show an alternative method of the present invention. In the method of producing an embodiment of the instant invention, such as the embodiment shown in FIG. 6, a bubble 702 is first formed in drum lid top 701. Subsequently, a piercing mandrel 703 is used to pierce the bubble, as shown by arrow 704, to extrude downward to create the opening 705, surrounded by interior wall 720 and exterior wall 725, as shown in FIG. 24A.

Figure 25:
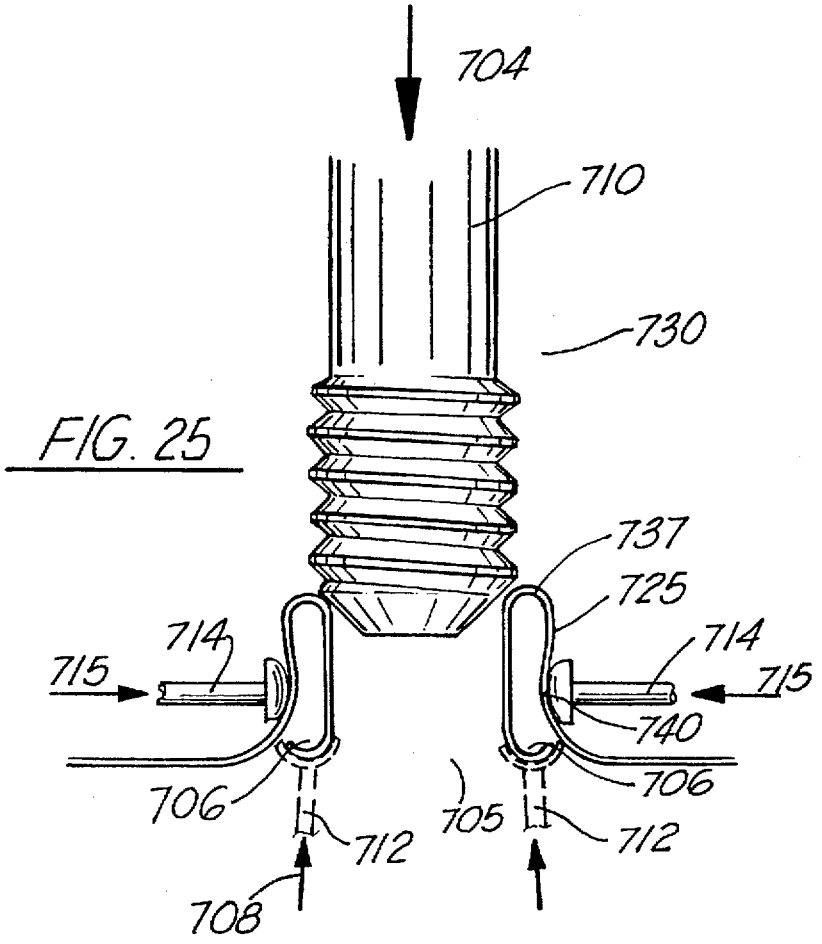
FIG. 25 is a sectional elevational view of an embodiment of the method of the present invention, showing the extrusion of the end of the inwardly reaching tube back upon itself, forming an outwardly and upwardly curled region.
Figure 26:
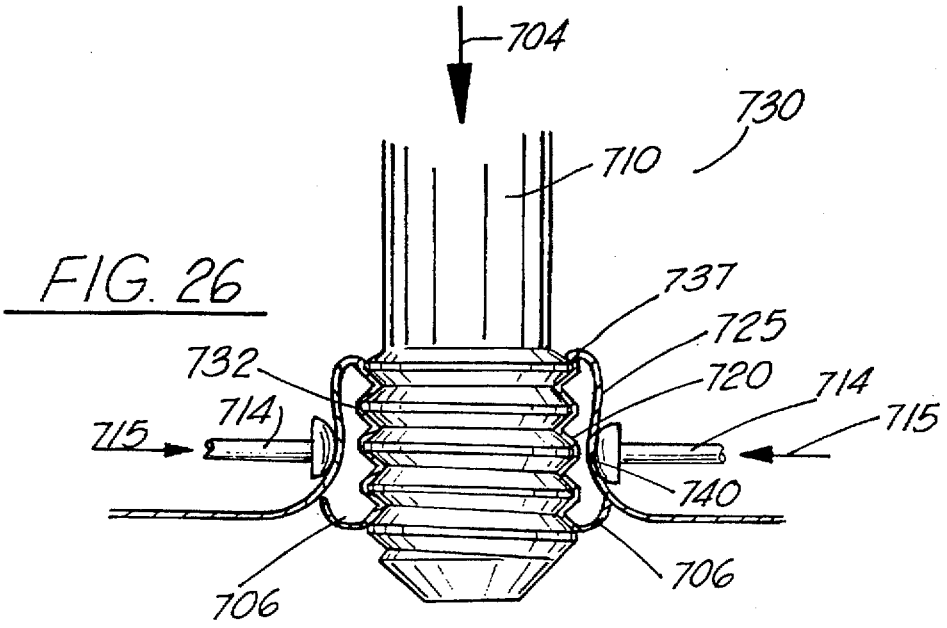
FIG. 26 is a sectional elevational view of an embodiment of the method of the present invention, showing both the threading of the interior of the tube with, for example, a thread forming tap, and the indentation of the exterior sides of the shoulder, forming an indentation.

FIGS. 25 and 26 further show the method of FIGS. 24 and 24A, wherein inwardly curled end 706 is formed by dies 712, whose progress are shown by arrows 708. This formation of end 706 provides both i) significant support for the tank opening 730, providing strength and support for subsequent thread formation as shown in FIG. 26, and ii) protection for the thread and the opening during tank cleaning when tank cleaning chains are used, such as shown in FIG. 7.

FIGS. 25 and 26 show the thread formation in opening 730. Thread former 710 forms interior thread 732 in interior wall 720 by compressive displacement of interior wall 720. Both dies 712 and curled ends 706, together and separately, provide important support during the process of thread formation by compressive displacement. These features both prevent the opening 730 from becoming unstable during the treading and ultimately protect the thread. For example, the reinforcing curl features at both the top shoulder 737 and bottom 706 of interior wall 720 act to stabilize the opening 730 during thread formation. For example, by being located on both the top and bottom of the wall 720, the material of the wall is prevented from becoming too thin during threading due to displacement of material either parallel to or away from the thread forming die 710. In addition, the presence of curled portion 706 provides a non-threaded end to interior wall 720, this is important in protecting the opening 730 against damage from the use of tank cleaning chains of the type shown, for example, in FIG. 7. Dies 712 further provide support for the material of opening 730 during thread formation.

FIGS. 25 and 26 also show dies 714 acting along arrows 715. These dies compress exterior wall 725 to form indentions 740. Indentions 740 can, for example, provide a locking location or site for a covering cap such as the type shown in FIG. 4 (Part No. 30; wherein annular concave flange portion 30A of cap seal 30 would interact with indentation 740 to form an external seal over the opening).

The following table lists the above-described part numbers and descriptions as used herein and on the drawings:

TABLE

PARTS LIST

| PART NUMBER | DESCRIPTION |
|---|---|
| 8 | tank cleaning chain |
| 9 | outlet member |
| 10 | drum apparatus |
| 11 | side wall |
| 12 | upper Edge |
| 13 | rib |

TABLE-continued

PARTS LIST

| PART NUMBER | DESCRIPTION |
|---|---|
| 14 | lid |
| 15 | rolled interface |
| 16 | larger opening outlet member |
| 17 | smaller opening |
| 18 | annular shoulder |
| 18A | concavity |
| 19 | upper end of shoulder |
| 20 | shoulder |
| 21 | annular convex section |
| 22 | lower end of shoulder |
| 23 | threaded section |
| 24 | unthreaded section |
| 25 | top of threaded section |
| 26 | bottom of threaded section |
| 27 | annular seal member |
| 28 | closure fitting |
| 29 | threads |
| 30 | cap seal |
| 30A | annular concave flange portion |
| 31 | outlet member |
| 32 | shoulder |
| 33 | connection |
| 34 | threaded portion |
| 35 | folded portion |
| 36 | unthreaded section |
| 37 | lower end |
| 38 | inside surface |
| 39 | outside surface |
| 40 | closure plug |
| 41 | external threads |
| 42 | flat top |
| 43 | annular lip |
| 44 | edge |
| 45 | surface |
| 46 | plastic seal |
| 47 | space |
| 48 | strap |
| 49 | annular ring |
| 50 | opening |
| 51 | cylindrical plastic cap |
| 52 | sidewall |
| 54 | beveled surface |
| 55 | locking tabs |
| 56 | inner annular surface |
| 57 | tab |
| 58 | recesses |
| 59 | outer surface |
| 85 | outlet member |
| 86 | fitting |
| 87 | L-shaped annular member |
| 88 | internal threads |
| 89 | external threads |
| 90 | arcuate annular portion |
| 91 | annular seal |
| 92 | closure plug |
| 93 | cylindrical wall |
| 94 | annular flange |
| 95 | top of plug |
| 96 | seal |
| 97 | flat annular surface |
| 114 | lid |
| 116 | larger opening outlet member |
| 118 | annular shoulder |
| 121 | annular interface portion between lid 114 and outlet member 116 |
| 122 | end |
| 123 | threaded section |
| 124 | top of threaded section |
| 125 | bottom of threaded section |
| 126 | unthreaded section |
| 127 | folded portion |
| 128 | annular seal member |
| 129 | closure fitting |

TABLE-continued

PARTS LIST

| PART NUMBER | DESCRIPTION |
|---|---|
| 129B | annular folded portion |
| 130 | threads of closure fitting 129 |
| 158 | gasket |
| 159 | cap or plug |
| 160 | threads of cap 159 |
| 170 | standard, commercially available cap seal |
| 214 | lid |
| 216 | larger opening outlet member |
| 218 | annular shoulder |
| 221 | annular interface portion between lid 214 and outlet member 216 |
| 222 | upper end |
| 223 | threaded section |
| 224 | top of threaded section |
| 225 | lower end |
| 226 | unthreaded section |
| 227 | folded portion |
| 314 | lid |
| 316 | outlet member |
| 318 | annular shoulder |
| 321 | annular interface portion between lid 314 and outlet member 316 |
| 322 | upper end |
| 323 | threaded section |
| 324 | top of threaded section |
| 326 | unthreaded section |
| 327 | folded portion |
| 414 | lid |
| 416 | outlet member |
| 418 | annular shoulder |
| 421 | annular interface portion between lid 414 and outlet member 416 |
| 422 | upper end |
| 423 | threaded section |
| 424 | top of threaded section |
| 425 | bottom of threaded section |
| 426 | unthreaded section |
| 427 | folded portion |
| 500 | outlet member |
| 501 | annular shoulder |
| 502 | annular convex section |
| 503 | U-shaped embossed section |
| 504 | U-shaped embossed section |
| 505 | upper end |
| 506 | lower end of threading |
| 507 | threaded portion |
| 508 | upper end of threaded portion |
| 509 | unthreaded section |
| 510 | folded portion |
| 511 | uppermost annular section of folded portion 510 |
| 512 | annular seal |
| 529 | closure fitting |
| 530 | threads of closure fitting |
| 550 | outlet member |
| 605 | top of closure fitting |
| 606 | folded section of closure fitting |
| 607 | end of closure fitting |
| 610 | folded portion |
| 611 | uppermost annular section of folded portion 610 |
| 701 | drum lid top |
| 702 | bubble formed in drum lid top |
| 703 | piercing mandrel |
| 704 | arrow |
| 705 | pierced opening |
| 706 | inwardly curled end |
| 707 | die |
| 708 | arrow |

TABLE-continued

| PARTS LIST | |
|---|---|
| PART NUMBER | DESCRIPTION |
| 710 | thread former |
| 712 | die |
| 714 | die |
| 715 | arrow |
| 720 | interior wall |
| 725 | exterior wall |
| 730 | tank opening |
| 732 | interior thread |
| 737 | top shoulder |
| 740 | indention |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A drum-type container construction comprising:

a) a drum having a pair of circular ends and a cylindrically shaped side wall;

b) one of the ends having a pair of openings including a fill opening of larger diameter and a vent opening of smaller diameter;

c) the larger diameter opening comprising an annular shoulder that is integrally formed with the parent metal of the drum end, said shoulder comprising:

i) an exterior annular wall that extends at generally right angles to the drum end, said exterior annular wall having an upper end, and a lower base, said lower base beginning at and rising from the plane of the drum end, said exterior annular wall extending above the plane of the drum end from the lower base to the upper end;

ii) an interior annular wall that extends at generally right angles to the drum and positioned internally and concentrically to the exterior annular wall, substantially abutting said exterior annular wall, said interior annular wall having an upper end, a lower section, and an interior annular wall spaced therebetween, the interior annular wall being internally threaded;

iii) a curved annular upper transition portion forming the top of the shoulder and joining the upper ends of the exterior and interior annular walls;

iv) the interior annular wall extending both above and into the plane of the drum end, thereby defining an upper section of the interior annular wall, extending above the plane of the drum end, the lower section of the interior annular wall extending into the plane of the drum end;

v) the upper section of the interior annular wall internally and concentrically abutting the exterior annular wall; and vi) the lower section of the interior annular wall within the plain of the drum end and curving upwardly and annularly outward away from the opening of the larger diameter opening to substantially abut the base of the exterior annular wall.

2. A drum-type container construction comprising:

a) a drum having a pair of circular ends and a cylindrically shaped side wall;

b) one of the ends having a pair of openings including a fill opening of larger diameter and a vent opening of smaller diameter;

c) the larger diameter opening comprising an annular shoulder that is integrally formed with the parent metal of the drum end, said shoulder comprising:

i) an exterior annular wall that extends at generally right angles to the drum end, said exterior annular wall having an upper end, and a lower base, said lower base beginning at and rising from the plane of the drum end, said exterior annular wall extending above the plane of the drum end from the lower base to the upper end;

ii) an interior annular wall that extends at generally right angles to the drum and positioned internally and concentrically to the exterior annular wall, substantially abutting said exterior annular wall, said interior annular wall having an upper end, a lower section, and an interior annular wall spaced therebetween, the interior annular wall being internally threaded;

iii) a curved annular upper transition portion forming the top of the shoulder and joining the upper ends of the exterior and interior annular walls;

iv) the interior annular wall extending both above and into the plane of the drum end, thereby defining an upper section of the interior annular wall, extending above the plane of the drum end, the lower section of the interior annular wall extending into the plane of the drum end;

v) the upper section of the interior annular wall internally and concentrically abutting the exterior annular wall; and vi) the lower section of the interior annular wall within the plain of the drum end and curving upwardly and annularly outward away from the opening of the larger diameter opening to substantially abut the base of the exterior annular wall; and d) a threaded closure member that engages the threads of the interior annular wall to close the larger diameter opening.

3. The drum-like container of claim 2 wherein the threaded closure member comprises an externally threaded stopper having a cap with an annular lip that extends outwardly over curved annular upper transition portion, thereby closing the larger diameter opening by forming a seal between the annular lip and the annular upper transition portion.

4. The drum-like container of claim 3 wherein the annular lip has an annular seal for closing the larger diameter opening by pressing the annular between the annular lip and the annular upper transition portion.

5. The drum-like container of claim 2 wherein the exterior annular wall has an annular recess.

6. The drum-like container of claim 5 further containing a cap seal that protectively covers the combination of the interior and exterior annular walls and the annular upper transition portion, the cap seal having an annular shoulder portion that registers in the annular recess of the exterior annular wall.

7. The drum-like container of claim 1 wherein the exterior annular wall has an annular recess.

8. A cylindrical drum container comprising;

a) a drum body with a cylindrical sidewall and a pair of opposed circular drum ends, including an upper drum end and a lower drum end;

b) the upper drum end having a larger fill opening and a smaller vent opening;

c) a closure plug with a cylindrically shaped externally threaded section;

d) the fill opening having an outlet that is of the parent metal of the upper drum end, said outlet comprising an annular shoulder that is drawn from the parent metal of the upper drum end;

e) the annular shoulder including an inner annular flange section and an outer annular flange section and a fold the defines the joint between the inner and outer annular flange sections;

f) the inner annular flange section having a lower end portion that extends upwardly from the drum end at a position generally opposite the fold, and having an inner threaded section that surrounds and communicates with the larger file opening and forms a threaded connection with the externally threaded closure plug; and g) wherein the inner and outer annular flange sections closely abut so that the outer closely supports the inner annular flange in the threaded section.

9. The drum apparatus of claim 8 wherein the drum is of a metallic construction.

10. The drum apparatus of claim 8 wherein the plug is of a metallic construction.

11. The drum apparatus of claim 8 wherein the inner and outer annular sections are each cylindrically shaped.

12. The drum apparatus of claim 8 wherein the inner and outer annular sections continuously engage one another at corresponding cylindrically shaped surfaces including an inner cylindrical surface of the outer annular section and an outer cylindrical surface of the inner annular section.

13. The drum apparatus of claim 8 wherein the outer drum section has a free lower end that is spaced from the upper drum end.

14. The drum apparatus of claim 8 further comprising a seal member that is carried by the closure plug for forming a seal between the closure plug and the drum outlet.

15. The drum apparatus of claim 14 wherein the seal member forms a seal at the fold during use.

16. The drum apparatus of claim 14 wherein the seal member forms a seal at the fold and at a portion of the outer annular section of the annular shoulder during use.

17. A metallic cylindrical drum container comprising;

a) a metallic drum body with a cylindrical sidewall and a pair of opposed circular metallic drum ends, including an upper drum end and a lower drum end, said drum ends having a thickness of between 14 and 24 gage metal;

b) the upper drum end having a larger fill opening and a smaller vent opening;

c) a closure plug with a cylindrically shaped externally threaded section and an annular skirt spaced radially away from the cylindrically shaped externally threaded section;

d) the fill opening having an outlet that is of the parent metal of the upper drum end, said outlet comprising an annular shoulder that is drawn from the parent metal of the upper drum end;

e) the annular shoulder including inner and outer annular flange sections and a fold the defines the joint between the inner and outer annular flange sections;

f) the inner annular flange section having a lower end portion that extends from the drum end and having an inner threaded section that surrounds and communicates with the larger fill opening and forms a threaded connection with the externally threaded closure plug;

g) wherein the inner and outer annular flange sections closely abut so that the outer annular flange section closely supports the inner annular flange section along the inner threaded section thereof; and h) wherein the skirt of the closure plug covers the combination of the inner annular flange section, the fold and at least a portion of the outer annular flange section.

* * * * *